United States Patent [19]

Birkle et al.

[11] Patent Number: 4,460,447

[45] Date of Patent: Jul. 17, 1984

[54] APPARATUS FOR THE GALVANIC DEPOSITION OF ALUMINUM

[75] Inventors: Siegfried Birkle, Höchstadt/A.; Klaus Stöger, Nuremberg; Johann Gehring, Spardorf, all of Fed. Rep. of Germany

[73] Assignee: Siemens Aktiengesellschaft, Berlin & Munich, Fed. Rep. of Germany

[21] Appl. No.: 515,127

[22] Filed: Jul. 19, 1983

[30] Foreign Application Priority Data

Sep. 29, 1982 [DE] Fed. Rep. of Germany ..... 3236138

[51] Int. Cl.[3] ..... C25D 17/20

[52] U.S. Cl. ..... 204/213

[58] Field of Search ..... 204/213

[56] References Cited

U.S. PATENT DOCUMENTS 2,762,772 9/1956 Jackson ..... 204/213

3,152,060 10/1964 Belke ..... 204/213

4,105,526 8/1978 Lewellen, Jr. ..... 204/213

4,360,409 11/1982 Stoeger et al. ..... 204/14 N

*Primary Examiner*—Thomas Tufariello

*Attorney, Agent, or Firm*—Hill, Van Santen, Steadman & Simpson

[57] ABSTRACT

In known devices for galvanic deposition of metal from electrolyte onto goods, wherein a galvanic drum contains electrolyte within a tank, the removal of metal undesirably deposited on the cathode contact or the replacement of used up cathode contacts from the drum has been very time-consuming and presented a contamination problem since these operations required opening of the galvanizing tank. The invention concerns a contact replacement or cleaning arrangement which can be done simply and does not necessitate undue exposure to ambient of the tank, since the used contact is removed within the tank and replaced by opening only a narrow passage through a galvanic drum axle.

2 Claims, 2 Drawing Figures

APPARATUS FOR THE GALVANIC DEPOSITION OF ALUMINUM

BACKGROUND OF THE INVENTION

The invention concerns an arrangement for replacement of cathode elements in a system for the galvanic deposition of aluminum from aprotic, oxygen-free and water-free, aluminum-organic electrolyte onto work piece or goods substrates.

U.S. Pat. No. 4,360,409 discloses a device for the galvanic deposition of aluminum onto work pieces from aprotic, organo-aluminum electrolytes which are free of oxygen and water using a heatable galvanizing tank which can be closed so as to be air-tight and which can be supplied with an inert gas. A rotatable galvanizing drum is arranged inside the galvanizing tank, and a feed container for the electrolyte is connected to the galvanizing tank. Two further containers serve to store inert liquids. The filling of the galvanizing drum is effected by means of a transport device for the bulk goods which are to be aluminized which device leads into the interior of the galvanizing tank via an airlock and which terminates above a sealable opening in the galvanizing drum. The opening and closure of the galvanizing drum can be effected from the exterior. The galvanizing drum can be emptied by means of a discharge container which can be supplied with inert gas and inert liquid and which is arranged beneath the galvanizing tank and is connected thereto via a lockable, tubular connecting component.

In this previous arrangement, a club-shaped cathode is connected at one end of a cable of conductive material disposed in the galvanizing drum. The other end of the cable is connected to an axle for the drum. This drum axle is then connected to a cathode terminal via a further exterior cable extending through the cover of the galvanizing tank. During the galvanic operation, aluminum is also deposited on the cathode so that it is necessary to demetallize the club-shaped cathode from time-to-time. Removal of the deposited metal at the cathode is necessary because dentritic metal growth otherwise develops which can disrupt metal deposition on the goods to be aluminum-plated at the contact surfaces. In the device of U.S. Pat. No. 4,360,409, replacement of the cathode is only possible when the galvanizing tank is opened. This is undesirable since the very air and humidity-sensitive electrolyte must be then replaced in this case.

Another possibility for removing deposited metal on the club-shaped cathode is that the power supply normally cathodically connected is anodically poled after the drum is emptied. The metal coating on the cathode then dissolves and re-deposits at the anodes. This dissolution or metal erosion process, however, is very time-consuming and cumbersome in aprotic electrolyte systems.

An object of the invention is to provide an arrangement such that the transmission contact, such as a club-shaped cathode, can be replaced or renewed in a simple manner in an aluminum galvanic deposition system.

SUMMARY OF THE INVENTION

In a metal galvanic deposit system, the galvanic drum containing electrolyte is rotatably seated on two axle stubs secured in the housing wall of the galvanizing tank. At least one contact device is introduced into and held at a central bore of one of the axle stubs disposed at the two end faces of the galvanizing drum. The contact is in the form of a club-shaped cathode to be disposed within the drum for contacting goods placed therein. The contact is preferably screwed to one end of a power cable. The other end of the cable is held in the central bore of the axle stub. An abutment means for screwing off from the cable the no longer usable contact club piece is attached in the central bore of the axle stub. The unscrewed, used up contact can be discharged to a drain container disposed beneath the drum when the drum is emptied, as are the galvanized plated goods. The cable can be withdrawn from the galvanizing drum at its end face and can be reintroduced after a new contact has been screwed on.

Other and further objects, purposes, advantages, aims, utilities, features and the like will be apparent to those skilled in the art from a reading of the present specification taken together with the drawings.

DETAILED DESCRIPTION OF THE PREFERRED EMBODIMENT

Figure 1:
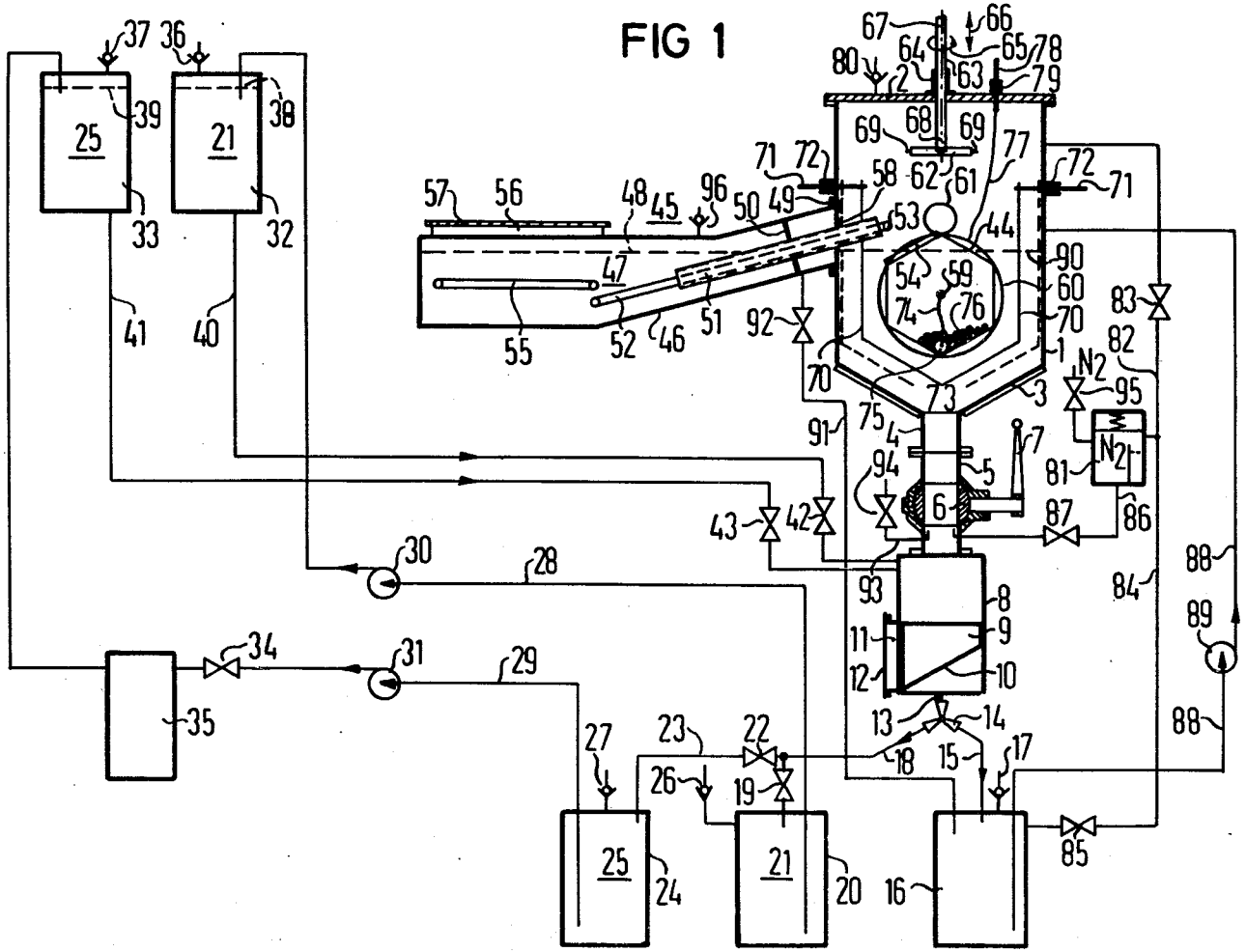
FIG. 1 is a schematic illustration of the device for galvanic deposition of aluminum disclosed in U.S. Pat. No. 4,360,409.

FIG. 1 illustrates a system for the galvanic deposition of aluminum from aprotic, oxygen-free and water-free, aluminum-organic electrolyte onto work pieces or goods, as disclosed in U.S. Pat. No. 4,360,409.

A galvanizing tank 1 is provided which is sealed in gas-tight fashion by a cover 2. The galvanizing tank 1 is provided with a heater unit 3 and possesses a discharge pipe 4 to which is flange attached a tubular connecting component 5 provided with a ball valve 6. Valve 6 can be actuated by means of a manual lever 7. The connecting component 5 is flange attached to a discharge container 8 which is fabricated as an unloading airlock and in which there is accommodated a perforated filling basket 9 having a sloping base 10. The filling basket 9 can be removed through hatch 11 which is arranged on the side of the discharge container 8 and which can be sealed in gas-tight fashion by means of a cover 12. A three-way valve 14 is attached to the base of the discharge container 8 through a pipeline 13 and is connected through a pipeline 15 to an electrolyte feed container 16 sealed in gas-tight fashion. The electrolyte feed container 16 is equipped with pressure relief valve 17.

The three-way valve 14 is connected through a pipeline 18 and through a valve 19 to a container 20 into which can be discharged an inert liquid 21 used for flooding or flushing the discharge container 8. The pipeline 18 is also connected through a valve 22 and a pipeline 23 to a further container 24 into which can be discharged an inert liquid 25 which is used for washing the bulk goods in the discharge container 8. The two containers 20 and 24 are provided with pressure relief valves 26 and 27. The container 20 and 24 are arranged beneath the three-way valve 14 so that the inert liquids 21 and 25 can reach this point by means of the force of gravity. By means of pumps 30 and 31, the inert liquids 21 and 25 can be pumped through pipelines 28 and 29 into feed container 32 and 33. A vaporizer 35 is connected into the pipeline 29 through a valve 34 and can be used to cleanse the inert liquid 25, used for washing purposes, of enriched electrolyte. The containers 32 and 33 are likewise equipped with pressure relief valves 36 and 37. The containers 32 and 33 are normally filled with inert liquids 21 and 25 as indicated by broken lines 38 and 39 which indicate the liquid level. The feed containers 32 and 33 are connected to the discharge container 8 via pipelines 40 and 41. Valves 42 and 43 which serve to control the inert liquids 21 and 25 are arranged in the pipelines 40 and 41.

A loading airlock 45 which is constructed as a liquid seal is provided for loading the galvanizing drum 44 arranged in the galvanizing tank. The loading airlock 45 consists of a container 46 which contains an inert liquid 47, the level 48 thereof therein being indicated by a broken line. The container 46 is attached in gas-tight fashion to the galvanizing tank 1 by means of a flange 49. In the container 46, a channel 51, which rises obliquely upwards, is attached by means of a diaphragm 50, and in this channel a transport device in the form of a conveyor belt 52 leads into the interior of the galvanizing tank 1. The end 53 of the transport belt 52 terminates above an opening 54 in the galvanizing drum 44. On the other side, the channel 51 is extended to such an extent that it is fully submerged into the inert liquid 47 so that the bulk goods which can be delivered by means of a further conveyor belt 55 reach the end of the conveyor belt 52 and from there are fed via the end 53 into the galvanizing drum 44. In the exemplary embodiment illustrated in FIG. 1, the conveyor belt 55 is fully submerged into the inert liquid 47. However, it can also be submerged obliquely from above into the inert liquid 47 so that the bulk goods can be placed more easily onto the conveyor belt 55. The conveyor belt 55 is loaded through an opening 56 in the container 46 which can be closed by means of a hatch cover 57. The diaphragm 50 is arranged in gas-tight fashion between the container 46 and the channel 51 and supports the channel 51. In order to increase the stability, a plurality of diaphragms 50 can be provided. Therefore, that end of the channel 51 which extends into the interior of the galvanizing drum 1 can be introduced slackly into the interior of the galvanizing drum 1 through an opening 58. This quite substantially simplifies assembly.

The galvanizing drum 44 has a generally hexagonal cross-section. Here, the drum casing is perforated in known manner. The galvanizing drum 44 is rotatably mounted on shaft 59 in the tank 1. The galvanizing drum 44 is equipped with a gear rim 60 which engages with a gear wheel 61. The gear wheel 61 is driven by an electric motor (not shown). The opening 54 of the galvanizing drum 44 is closable by a cover 62. As the interior of the galvanizing drum 1 is sealed in gas-tight fashion, the cover 62 can be lifted by means of a lifting mechanism 63 which leads tightly through the cover 2 of the galvanizing tank 1 by means of guides 64. As indicated by the arrows 65 and 66, the lifting mechanism 63 can be moved both in the axial direction and about its axis of rotation 67. At the lower end 68 of the lifting mechanism is arranged an unlocking mechanism (not shown in detail) with the aid of which the unlocking pins 69 arranged on the cover 62 can be operated. These unlocking pins 69 form a shape-locking connection with corresponding bores at the edge of the opening 54 of the galvanizing drum 44.

The galvanizing drum 44 is surrounded by two anodes 70 arranged homologously, where the anode terminals 71 lead out of the galvanizing tank 1 through anode ducts 72. By moving the anode terminals 71, the anodes 70 can be adjusted towards the walls of the galvanizing tank 1 as indicated in broken lines. This exposes an opening 73 so that the contents of the galvanizing drum 44 can be emptied into the discharge container 8 through the discharge pipe 4.

The shaft 59 is attached through a cable 74 composed of conductive material to a club-shaped cathode 75 which can be actively connected to the bulk goods 76 contained in the galvanizing drum 44. The shaft 59 is connected via a further electrical cable 77 to a cathode terminal 78 which leads through an opening 79 through the cover 2 of the galvanizing tank 1. The cover 2 of the galvanizing tank also possesses a pressure relief valve 80.

Also provided is an inert gas container 81 which is connected through a pipeline 82 and a valve 83 to the galvanizing tank 1, and through a pipeline 84 and a valve 85 to the electrolyte feed container 16. The inert gas container 81 is connected to the connecting component 5 through a further pipeline 86 and a valve 87.

The electrolyte feed container 16 is connected via a pipeline 88 to the galvanizing tank 1 so that, when necessary, a pump 80 can be used to pump electrolyte into the galvanizing tank 1 to maintain therein a predetermined level 90 as indicated by the broken lines.

The area of the container 46 behind the diaphragm 50 is connected to the electrolyte feed container 16 via a pipeline 91 and a valve 92. The container 46 is also equipped with a pressure relief valve 96. Following the washing of the bulk goods 76 with inert liquid 25, the discharge container 8 can either be ventilated or subjected to inert gas via the valve 94 and a pipeline 93. A valve 95 in the inert gas feed container 81 is needed for the inert gas, such as $N_2$, requirement from a bottle.

Figure 2:
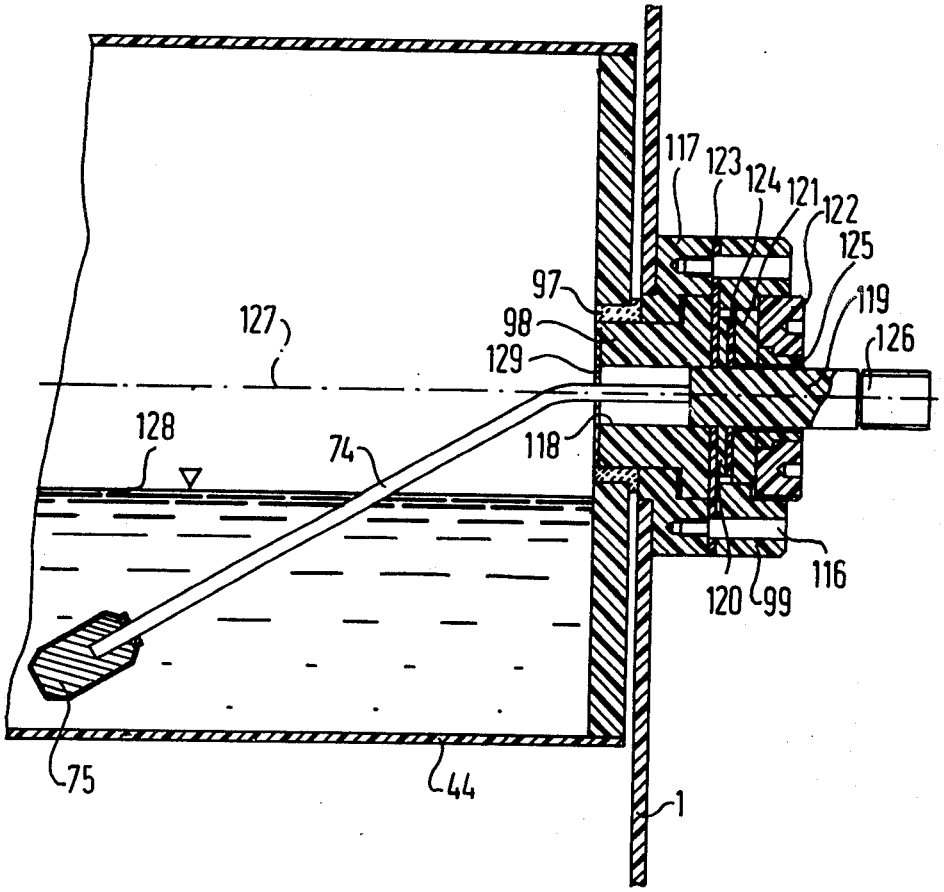
FIG. 2 is a fragmentary cross-sectional view of a rotatable galvanizing drum for use in the device of FIG. 1 and having means for simplified replacement of a no longer usable contact constructed in accordance with the invention.

FIG. 2 shows an inventive arrangement for a quick and safe replacement of the club-shaped cathode contact 75 in a galvanizing drum such as 44 of the device of FIG. 1. The galvanizing drum 44 is supported for rotation at opposed end faces respectively on a bearing bush 97 disposed about an axle stub 98 made of insulative material. The axle stub 98 is secured in the wall of the galvanizing tank 1 by attachment to a ring 117. An exterior ring 99 is secured by means of screws 116 to an exterior face of the ring 117. A cylindrical projection 119 fits in the exterior ring 99 and this cylindrical projection contains an electrical power cable 74. The cable 74 extends through the cylindrical projection 119 and on through a hollow central bore 118 formed in the axle stub 98.

The club-shaped cathode 75 is removable attached to the free end of the cable 74, which extends into the drum 44, by screw thread means. The cathode contact 75 has a diameter which is slightly smaller than that of the bore 118 so that it can be introduced into the drum 44 from the outside through this bore.

The projection 119 is provided with an upstanding concentric flange 120 which is pressed against the exterior face of the axle stub 98 by a screwable thrust collar 112 acting against a buffer plate 121. Sealing washers or other packings 123 and 124 are inserted between the axle stub 98 and flange 120 on the one hand and the flange 120 and the plate 121. The thrust collar 122 exhibits an outside thread for screwing into the ring 99 provided with an inside thread. A synthetic bush 125 is preferably inserted into the thrust collar 122 for insulating purposes. The end of the cylindrical projection 119 is provided with a thread 126 for the cathodic power terminal.

Replacement of the club-shaped cathode contact 75 takes place as follows. The thrust collar 122 is screwed out of the bore of the ring 99 provided with a thread and the plate 121 is then removed. After unscrewing the power terminal, the cathode contact 75 can be drawn toward the bore 118 by operator movement of the projection 119 out of the bore 118. It is necessary that the electrolyte level in the drum 44 be lowered below the drum axle level 127 to about the level 128, which can be undertaken in a manner known per se such as by means of bleeding off a specific amount of electrolyte into the drain container.

The bore 118 is kept as small as possible by virtue of the contact 75 being screwed onto the cable 74. A ring-shaped abutment 129 in the form of a cutting edge is then disposed at the interior face of the bore 118. The club-shaped contact, now unusably coated with aluminum, is retracted up to the abutment 129 and rotated until the contact piece 75 releases from the cable 74 and drops into the galvanizing drum 44. The cable 74 can now be withdrawn through the bore 118. A new club-shaped contact 75 is then screwed onto the cable and reintroduced back into the drum 44 through the bore 118. After that, the plate 121 is inserted and the thrust collar 122 is subsequently screwed in.

In this manner, the replacement of the contact can be undertaken very quickly and without large amounts of air penetrating into the galvanizing tank through the bore 118, which could contaminate the electrolyte.

A further possibility for the inventive contact replacement arrangement is that a chain or cable is introducible through, removable from, and held at central bores of the axle stubs disposed at both end faces of the galvanizing drum. The chain or cable may being removable from the tank through fluid lock means for the purpose of replacement or cleaning. The power lead may be designed in the form of an endless chain or cable. Thus, the current feed can be renewed at any time given an emptied drum in that a corresponding length of this cable is pulled out or pulled into the galvanizing drum or tank through fluid locks from, for example, left to right. The chain or cable can then be cleaned or dried outside of the galvanizing tank, for example, by means of stripping deposited metal with a suitable acid or caustic solution.

Although various minor modifications may be suggested by those versed in the art, it should be understood that we wish to embody within the scope of the patent warranted hereon all such modifications as reasonably and properly come within the scope of our contribution to the art.

We claim:

1. Apparatus for replacing a cathode contact disposed within a galvanizing drum for containing electrolyte rotatably mounted within a fluid-tight galvanizing tank charged with an inert gas comprising axle stubs secured in opposed housing walls of said tank, said drum being seated for rotation at opposed end faces thereof on said axle stubs, a central bore extending through at least one of said axle stubs defining a hollow path between the interior of said drum and the exterior of said tank, an electrical cable extending through said central bore having an interior end for disposition in said drum and an exterior end for attachment to a power terminal, a cathode contact removably screw-thread attached to the interior end of said cable, said cathode contact's maximum cross-sectional area being slightly smaller than the minimum cross-sectional area of said central bore, a projection means about said cable for plugging said central bore as said cable extends therethrough, and an abutment member disposable at the interior end face of said central bore, such that said cathode contact can be drawn by said cable into engagement with said abutment member and unscrewed from said cable within said drum.

2. The apparatus of claim 1, further comprising removable clamp means for pressing said projection means against said axle stub.

* * * * *